US008037793B2

(12) United States Patent
Nakai

(10) Patent No.: US 8,037,793 B2
(45) Date of Patent: Oct. 18, 2011

(54) STRIPPER PLATE MOUNTING APPARATUS

(75) Inventor: Hiroshi Nakai, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 530 days.

(21) Appl. No.: 12/280,058

(22) PCT Filed: Feb. 19, 2007

(86) PCT No.: PCT/JP2007/052989

§ 371 (c)(1),
(2), (4) Date: Oct. 21, 2008

(87) PCT Pub. No.: WO2007/097291

PCT Pub. Date: Aug. 30, 2007

(65) Prior Publication Data

US 2010/0162866 A1 Jul. 1, 2010

(30) Foreign Application Priority Data

Feb. 24, 2006 (JP) ..... 2006-048600

(51) Int. Cl.
*B21D 45/08* (2006.01)

(52) U.S. Cl. ..... 83/140; 83/698.91

(58) Field of Classification Search ..... 83/129–131, 83/136–146, 588, 684, 686, 698.61, 698.91
See application file for complete search history.

(56) References Cited

U.S. PATENT DOCUMENTS 4,248,111 A * 2/1981 Wilson et al. ..... 83/140
5,081,891 A * 1/1992 Johnson et al. ..... 83/140
5,127,293 A * 7/1992 Chatham ..... 83/136
6,082,516 A * 7/2000 Willer ..... 192/223.2
6,895,849 B2 * 5/2005 Rosene et al. ..... 83/698.41
2004/0011178 A1 1/2004 Iwamoto et al.
2005/0220926 A1 10/2005 Naito et al.
2008/0092713 A1 4/2008 Takahashi et al.

FOREIGN PATENT DOCUMENTS

| | | |
|---|---|---|
| EP | 1334782 | 8/2001 |
| JP | 4-167934 A | 6/1992 |
| JP | 2002-205130 A | 7/2002 |
| JP | 2005-528986 A | 9/2005 |
| WO | 03/103872 | 12/2003 |

OTHER PUBLICATIONS

English language Abstract and translation JP 2002-205103 A.
English language Abstract and translation JP 4-167934 A.

* cited by examiner

*Primary Examiner* — Edward Landrum
(74) *Attorney, Agent, or Firm* — Greenblum & Bernstein P.L.C.

(57) ABSTRACT

A stripper plate mounting apparatus is for mounting a stripper plate (21) in a detachable and replaceable manner on a front end portion of a punch guide (5) into which a punch (17) is fitted movably upward and downward. The apparatus includes: an adaptor (35), for holding the stripper plate (21), detachably provided in a front end portion of the punch guide (5); and lock mechanisms (43), capable of fixing the adaptor (35) to the punch guide (5), provided in multiple locations on the outer periphery of the front end portion thereof. The lock mechanisms (43) each include: a lock piece (53) which is always biased outward in a radial direction by biasing means, and which is engageable with, and detachable from, the lock part (41); and a lock-holding piece (63) for locking and holding the lock piece (53) to an inward position when the lock piece (53) is pressed and moved inward in the radial direction.

4 Claims, 4 Drawing Sheets

PRIOR ART (A)

(B)

(A)

(B)

STRIPPER PLATE MOUNTING APPARATUS

TECHNICAL FIELD

The present invention relates to a stripper plate mounting apparatus for mounting a stripper plate in a detachable and replaceable manner on a punch die used for punch press. Specifically, the present invention relates to a stripper plate mounting apparatus capable of easily attaching and detaching a stripper plate to and from a punch die.

BACKGROUND ART

A punch die used for punch press is provided with a stripper plate for pressing down the die to a plate-shaped workpiece, while the workpiece is processed in a punching process with a punch, for the purpose of preventing a deformation of punching during the punching process. When the edge part of the punch is worn, the punch is removed from the punch die, and the edge part is ground again. In this case, it is necessary to remove the stripper plate from the punch die. With this background, proposals have been made on a configuration which allows the stripper plate to be mounted on and detached from the punch die easily. Such a configuration is disclosed, for example, in a Patent Brochure of Japanese National Publication of Translation Version (Kohyo) No. 2005-528986 (Patent Document 1).

Figure 1:
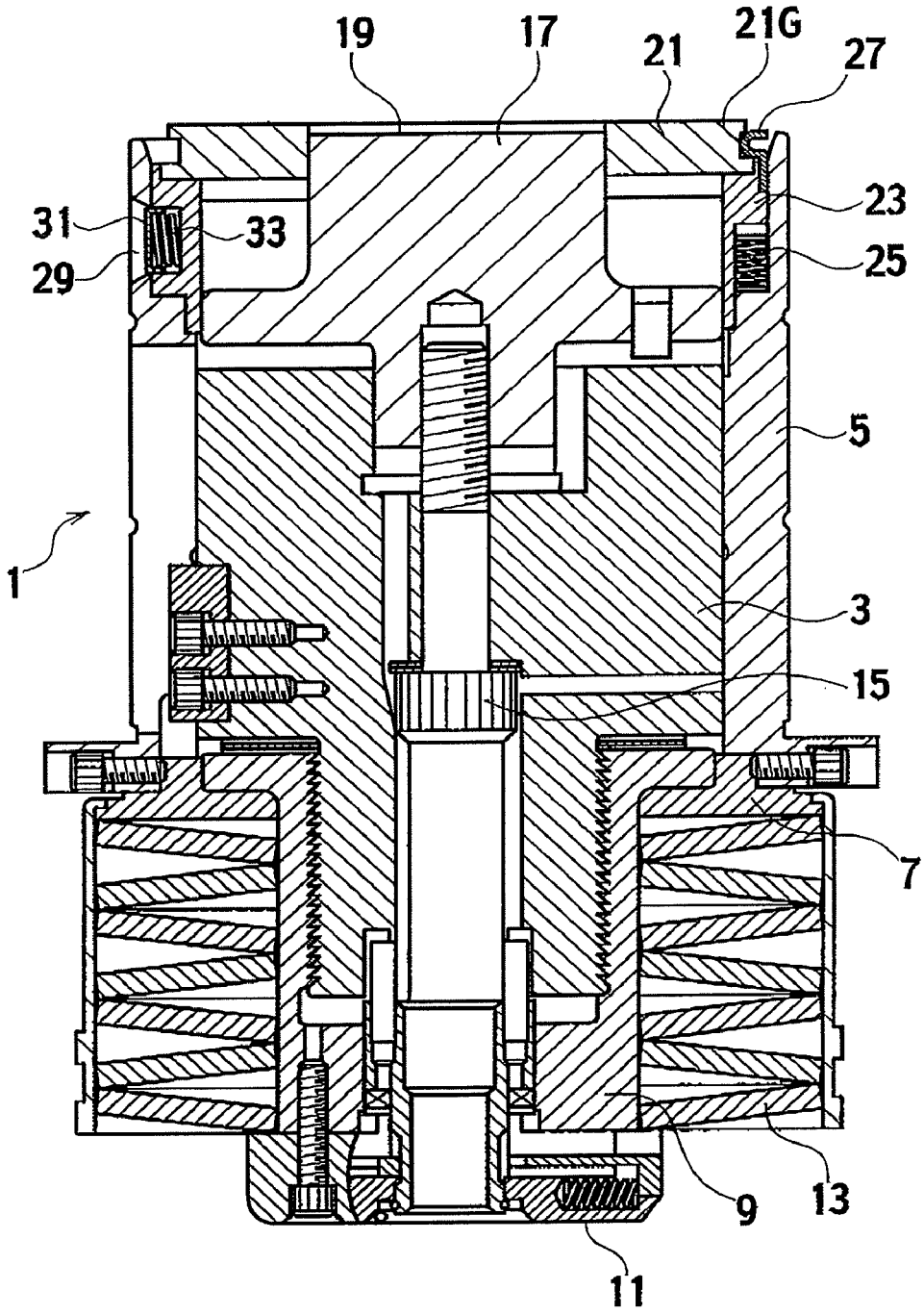

A punch die described in Patent Document 1 has a configuration as shown in FIG. 1. Specifically, the punch die 1 includes a cylindrical punch guide 5 for guiding a punch body 3 movable upward and downward. A retainer collar 7 is attached to an end side of this punch guide 5 with a bolt or the like. In addition, a punch head 11 is attached to an end portion of a cylindrical punch driver 9 adjustably screwed to an adjustable screw part provided to an end side of the punch body 3. A stripper spring 13 is set resiliently between the punch head 11 and the retainer collar 7.

A punch block 17 is attached in a detachable and replaceable manner to the other end side of the punch body 3 with a bolt 15. A punch edge part 19 is formed in a front end portion of this punch block 17. A disk-shaped stripper plate 21 surrounding this punch edge part 19 is mounted in a detachable and replaceable manner on a front end portion of the punch guide 5.

Specifically, a cylindrical holder 23 for holding the stripper plate 21 to the front end portion of the punch guide 5 is fitted into an inner circumferential surface of the front end portion thereof to be movable upward and downward. Furthermore, springs 25 each for always biasing the holder 23 upward are set resiliently in spring housing concave parts provided in multiple locations on the outer circumferential surface of the holder 23, respectively. Moreover, plate lock-holding pieces 27 are respectively provided in other multiple locations on the outer circumferential surface of the holder 23 to be swingable (inward and outward) in radial directions. The plate lock-holding pieces 27 are each for integrally locking and fixing the stripper plate 21 to the holder 23 by engaging with an annular groove 21G formed in the outer circumferential surface of the stripper plate 21.

In addition, lock buttons 31 are respectively provided, movably in radial directions (radius directions), in yet other multiple locations of the outer circumferential surface of the holder 23. The lock buttons 31 are engageable with, and detachable from, lock holes 29 which extend in the radial directions (radius directions), and which are respectively provided to multiple locations in the punch guide 5. Incidentally, the lock buttons 31 are always biased outward by their respective built-in springs 33.

In the foregoing configuration, as shown in the drawing, in a state in which: the holder 23 is inserted in the punch guide 5 against biasing forces from the respective springs 25; the plate lock-holding pieces 27 provided to the holder 23 are slid inward by the inner circumferential surface of the front end of the punch guide 5, and thus holds the stripper plate 21; and the lock buttons 31 provided to the holder 23 engage with the respective lock holes 29 of the punch guide 5, the stripper plate 21 is in the state of being integrated with the punch guide 5, and is thus not detachable.

The stripper plate 21 is detached from the punch guide 5 and replaced with a new one in a following way. Specifically, the lock buttons 31 provided in the multiple locations are simultaneously pressed against the respective springs 33, and thereby the engagement of the lock holes 29 with the respective lock buttons 31 is released. With this operation, the holder 23 is moved upward in FIG. 1 by the biasing forces from the respective springs 25. Once the holder 23 is moved upward, the plate lock-holding pieces 27 become slidable outward, and thus the fixation of the stripper plate 21 is released. For this reason, it is possible to remove the stripper plate 21 from the holder 23.

Conversely, by setting the stripper plate 21 on the holder 23, and subsequently by pressing the holder 23 toward the inside of the punch guide 5 against the biasing forces from the respective springs 25, the stripper plate 21 is fixed. Specifically, once the holder 23 is pressed and moved toward an inner side of the punch guide 5, the plate lock-holding pieces 27 move inward in their respective radial directions (radius directions), and thus integrally fix the stripper plate 21. Thereafter, once the holder 23 is pressed, the lock buttons 31 provided to the holder 23 engage with the respective lock holes 29 provided to the punch guide 5, and thus the holder 23 is fixed thereto. Thereby, the stripper plate 21 is integrated with the punch guide 5.

As learned from the foregoing descriptions, the conventional configuration has a problem that the multiple lock buttons 31 have to be simultaneously pressed against the respective springs 33. In addition, because the holder 23 is pushed upward by the biasing forces from the springs 25, the holder 23 may sometimes be pushed up so forcefully and abruptly, if the punch edge part 19 in the punch block 17 is relatively large and the stripper plate 21 is relatively light in weight, that there is another problem that an operator feels that the stripper plate is unstable. Moreover, in the case of the conventional configuration, after the stripper plate 21 is repeatedly mounted and detached, some plate lock-holding pieces 27 may break. For these reasons, further improvements are requested.

The present invention has been made for the purpose of solving the above-described problems. An object of the present invention is to provide a stripper plate mounting apparatus which allows an adaptor holding a stripper plate to be fixed to, and detached from, a punch guide easily.

DISCLOSURE OF THE INVENTION

For the purpose of achieving the object, a first aspect of the present invention is a stripper plate mounting apparatus for mounting a stripper plate in a detachable and replaceable manner above a front end portion of a punch guide into which a punch including an edge part in its front end portion is fitted movably upward and downward. The apparatus includes: an adaptor detachably provided to the front end portion of the punch guide, the adaptor holding the stripper plate, and multiple lock parts being respectively formed in multiple locations on the adaptor; and multiple lock mechanisms provided in multiple locations on an outer periphery of the front end portion of the punch guide so as to correspond to locations of multiple lock parts formed in the stripper plate, respectively. In the foregoing configuration, the lock mechanisms each include: a lock piece capable of being locked to, and detached from, a corresponding one of the lock parts formed in the adaptor; biasing means for always biasing the lock piece outward in a radial direction (a radius direction); and a lock-holding piece for locking and holding the lock piece to an inward position when the lock piece is pressed and moved inward in the radial direction (the radius direction). With the foregoing configuration, the adaptor is fixed to the punch guide by use of the lock mechanisms.

A second aspect of the present invention which depends on the first aspect is the stripper plate mounting apparatus, in which the lock-holding piece is pressed and biased in a direction in which the lock-holding piece approaches the lock piece, and in which the lock-holding piece is provided movably integrally with the lock piece in the radial direction (the radius direction).

A third aspect of the present invention which depends on the first aspect or the second aspect is the stripper plate mounting apparatus in which an engagement concave part is formed in an opposing surface of the lock piece, the opposing surface being opposed to the lock-holding piece, and in which the lock-holding piece includes a convex part engageable with, or detachable from, the engagement concave part.

A fourth aspect of the present invention which depends on any one aspect of the first to third aspects is the stripper plate mounting apparatus, in which the lock-holding piece protrudes more outward than the lock piece when the adaptor is removed from the punch guide.

The first to fourth aspects of the present invention makes it possible to fix the adaptor holding the stripper plate to the punch guide by use of the lock mechanisms, and to remove the adaptor from the punch guide by releasing the adaptor from the fixation by use of the lock mechanisms. For this reason, the adaptor is not pushed up by the punch guide. Regardless of the weight of the stripper plate, the adaptor holding the stripper plate is fixed to the punch guide, and is released from its fixation to the punch guide, in a fixed position.

In addition, when the fixation by use of the lock mechanism is intended to be released, the multiple lock pieces can be individually pressed, and thus the multiple lock pieces should not be simultaneously operated by pressing them. This makes it possible to release the fixation easily.

BRIEF DESCRIPTION OF THE ACCOMPANYING DRAWINGS

FIG. 1 is an explanatory cross-sectional view showing a configuration of a conventional type of punch die.

Figure 2:
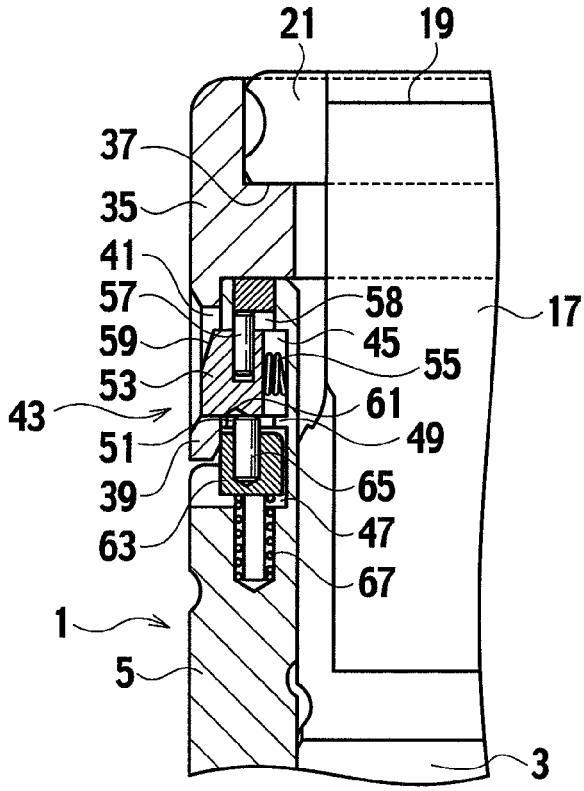
Figure 2:
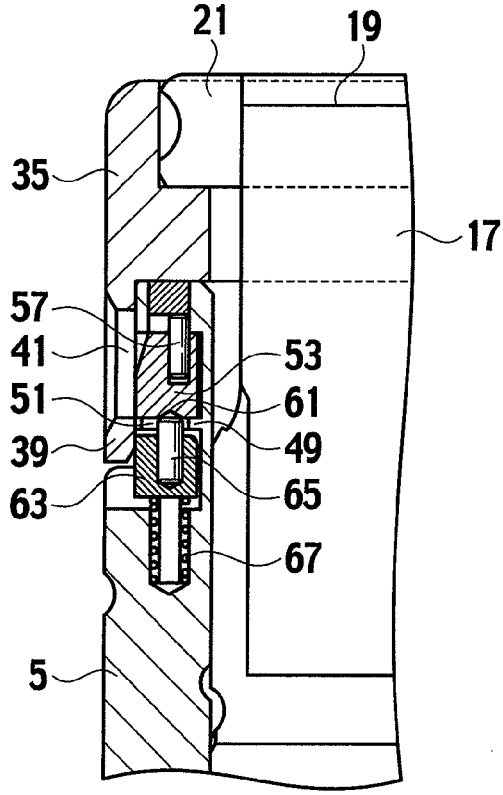

FIGS. 2(A) and 2(B) are explanatory cross-sectional views each showing a configuration of a stripper plate mounting apparatus according to an embodiment of the present invention.

Figure 3:
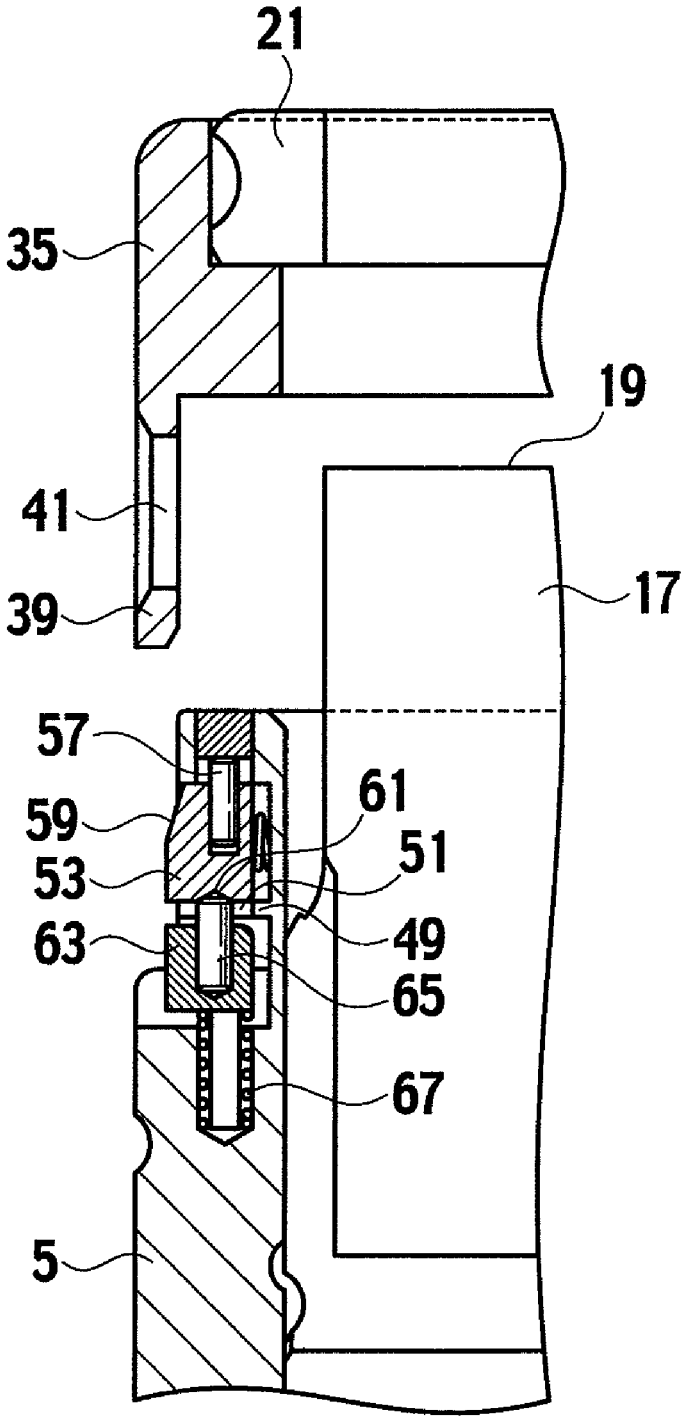

FIG. 3 is an explanatory cross-sectional view showing the state in which the stripper plate mounting apparatus according to the embodiment of the present invention is released from its lock.

Figure 4:
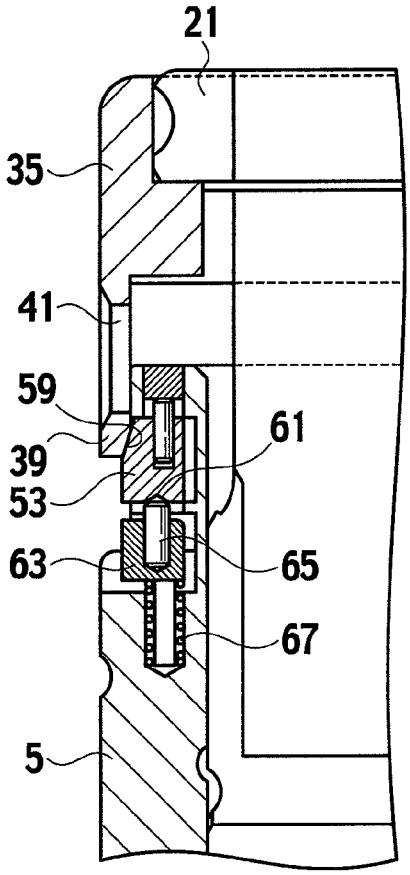
Figure 4:
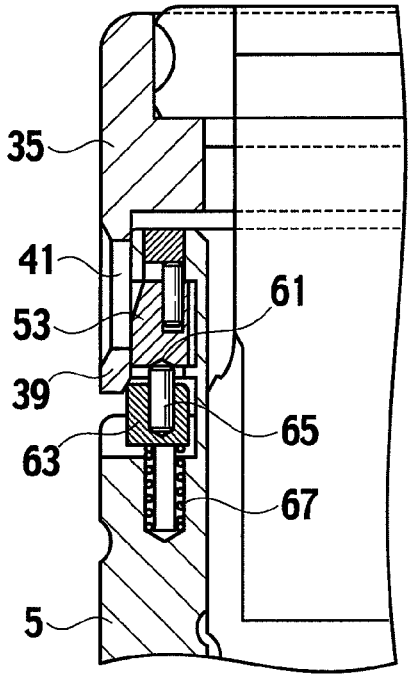

FIGS. 4(A) and 4(B) are explanatory cross-sectional views each showing the process how the stripper plate mounting apparatus according to the embodiment of the present invention is being locked.

BEST MODE FOR CARRYING OUT THE INVENTION

Referring to the drawings, descriptions will be provided hereinbelow for an embodiment of the present invention. Components which play the same functions as components in the above-described conventional configuration are denoted by the same reference numerals, and duplicated descriptions will be omitted. In addition, the overall configuration of the punch die is almost the same as the general configuration of the conventional type of punch die. For this reason, illustrations and descriptions for the overall configuration of the punch die will be omitted. Instead, detailed descriptions will be provided for a configuration for mounting the stripper plate in a detachable and replaceable manner on the punch guide.

Referring to FIGS. 2(A) and 2(B), the overall configuration of a punch die 1 is almost the same as the configuration of the conventional type of general punch die. Like the conventional type of punch guide, a punch body 3 is fitted into a cylindrical punch guide 5 to be movable upward and downward. This punch body 3 is provided with a punch block 17 which has a punch edge part 19 formed in its front end portion. In addition, a cylindrical adaptor 35 including a disk-shaped stripper plate 21 in a detachable and replaceable manner is mounted on the front end portion of the punch guide 5 in a fixable and releasable manner.

Specifically, an annular attachment step part 37 to mount the stripper plate 21 is formed in the front-end-side inner circumferential surface of the adaptor 35. In addition, the adaptor 35 integrally includes a thin cylindrical fit-on part 39 which fits onto the outer circumferential surface of a front end portion of the punch guide 5. Furthermore, as lock parts, lock holes 41 penetrating the cylindrical fit-on part 39 in the radial directions (in the radius directions) are respectively formed in multiple locations on the cylindrical fit-on part 39 in the circumferential direction.

Corresponding to the lock holes 41 in multiple locations, lock mechanisms 43 capable of fixing the adaptor 35 to the punch guide 5 are provided in multiple locations on the outer periphery of the front end portion of the punch guide 5, respectively. More specifically, a first concave part 45 and a second concave part 47 both being open outward in a radial direction (outward in a radius direction) are provided in each of the multiple locations on the outer periphery of the front end portion of the punch guide 5 in a way that the first concave part 45 and the second concave part 47 keep away from each other in the longitudinal direction of the punch guide 5. The first concave part 45 is located closer to the front end side of the punch guide 5 than the second concave part 47. A long hole 51 elongated in the radial direction (in the radius direction) penetrates a partition wall 49 for demarcating the first concave part 45 and the second concave part 47.

Inside each first concave part 45, a lock piece 53 engageable with and detachable from (capable of being locked to and being detached from) its corresponding lock hole 41 is installed movable in a radial direction (a radius direction). This lock piece 53 is always biased outward in the radial direction by biasing means (biasing module) 55, such as a coil spring, which is set resiliently in the first concave part 45. For the purpose of preventing the lock piece 53 from coming out of the first concave part 45 in the radial direction, a come-out prevention pin 57 is provided to the lock piece 53. A front end portion of this come-out prevention pin 57 movably engages with a long hole 58 elongated in the radial direction (a radius direction), the hole being formed in the punch guide 5.

An inclined surface 59 capable of being pressed by an end edge portion of the cylindrical fit-on part 39 is formed in a front-end-side exterior of the lock piece 53. A conical or spherical engagement concave part 61 is formed in a contact surface of the lock piece 53, the surface being in contact with the partition wall 49.

Inside the second concave part 47, a lock-holding piece 63 is installed. The lock-holding piece 63 is movable along the second concave part 47 in a radial direction (in the radius direction), as well as is movable in directions in which the lock-holding piece 63 approaches the lock piece 53, and in which the lock-holding piece 63 is detached from the lock piece 53. This lock-holding piece 63 includes an engagement pin 65 as a convex part which is engageable with and detachable from the engagement concave part 61 provided to the lock piece 53 while penetrating the long hole 51. Furthermore, the lock-holding piece 63 is always biased to the side of the lock piece 53 by biasing means 67, such as a coil spring, which is set resiliently in the second concave part 47. Moreover, when the lock piece 53 and the lock-holding piece 63 are both moved outward in the radial direction, the lock-holding piece 63 is in the state of protruding slightly more outward than the lock piece 53.

In the foregoing configuration, while, as shown in FIG. 2(A), the lock piece 53 is in engagement with the lock hole (lock part) 41 in the adaptor 35 on which the stripper plate 21 is mounted, the adaptor 35 is in the state of being integrally fixed to the punch guide 5. At this time, the lock piece 53 is in the state of being moved in an outward position by the biasing means 55. In addition, the lock-holding piece 63 is in the state of being moved in an inward position by the cylindrical fit-on part 39 of the adaptor 35. The engagement pin 65 provided to this lock-holding piece 63 is in the state of being moved in a position inward of the engagement concave part 61 formed in the lock piece 53 inwardly in the radial direction after detached from the engagement concave 61.

While, as described above, the lock piece 53 in the lock mechanism 43 is in engagement with, and is being locked to, the lock hole 41 in the adaptor 35, if the lock piece 53 is moved inward by pressing the lock piece 53 against the biasing force of the biasing means 55, as shown in FIG. 2(B), the lock piece 53 is detached from the lock hole 41, and concurrently the engagement pin 65 provided to the lock-holding piece 63 and the engagement concave part 61 formed in the lock piece 53 engage with each other. This engagement is held by the upward biasing force from the biasing means 67. For this reason, multiple lock pieces 53 are capable of being individually or simultaneously moved inward, and thereafter are capable of being held in the state of being moved in their respective inward positions. Thereby, as shown in FIG. 2(B), the adaptor 35 is capable of being removed from the punch guide 5 upward. Thereby, the stripper plate 21 is capable of being replaced with a new one by detaching the stripper plate 21 from the adaptor 35, and by mounting the new one on the adaptor 35.

Once the adaptor 35 is removed from the punch guide 5 upward, the restriction of the outward movement of each lock-holding piece 63 by the cylindrical fit-on part 39 in the adaptor 35 is released. As a result, the lock-holding piece 63 is moved outward by an effect of the biasing means 55 with the engagement concave part 61 of the lock piece 53 and the engagement pin 65 of the lock-holding piece 63 being in engagement with each other. Thereafter, the engagement pin 65 is stopped in a position restricted by the long hole 51 provided in the partition wall 49. Under this condition, the lock-holding piece 63 is in the state of protruding slightly more outward than the lock piece 53 (see FIG. 3).

Subsequently, when, as shown in FIG. 3, the adaptor 35 is in the state of being removed from the punch guide 5, if the cylindrical fit-on part 39 of the adaptor 35 is again fitted onto the front end portion of the punch guide 5, as shown in FIG. 4(A), the cylindrical fit-on part 39 abuts on the inclined surface 59 of the lock piece 53, and the cylindrical fit-on part 39 presses and moves the lock piece 53 inward against the biasing means 55.

Thereafter, once, as shown in FIG. 4(B), the cylindrical fit-on part 39 abuts on the lock-holding piece 63, the lock-holding piece 63 moves rightward in FIG. 4(B) because, as described above, the lock-holding piece 63 is in the state of protruding slightly more outward than the lock piece 53. The rightward movement of the lock-holding piece 63 releases the lock piece 53 from the engagement of the engagement pin 65 provided to the lock-holding piece 63 with the engagement concave part 61 provided to the lock piece 53. In response to this release, the lock piece 53 moves leftward due to the effect of the biasing means 55 in FIG. 4(B), and thus engages with the lock hole 41 in the adaptor 35. Thereby, all return to the original condition shown in FIG. 2(A).

As learned from the foregoing descriptions, when the fixation of the adaptor 35 to the punch guide 5 by the lock mechanisms 43 is released, the adaptor is held in such a stable condition that the adaptor is maintained at the same height without moving upward or downward. This makes it possible to do things such as mounting or detaching the adaptor 35 on or from the punch guide 5, and replacing the adaptor 35.

In addition, when the fixation of the adaptor 35 to the punch guide 5 by the lock mechanisms 43 is intended to be released, even in a case where the lock pieces 53 in the respective lock mechanisms 43 are individually operated by pressing them inward, each lock piece 53 is capable of being locked and held in the state of being moved in its inward position. For example, the lock operated by the lock mechanisms 43 is capable of being sequentially released. This makes it possible to releasing the lock easily. Thereby, it is possible to solve the above-described problem with the prior art.

Note that the entire contents of Japanese Patent Application No. 2006-048600 (filed on Feb. 24, 2006) are incorporated in the description attached to this application by reference.

The present invention is not limited to the foregoing descriptions for the embodiment of the present invention. The present invention can be carried out in various modes by modifying the present invention depending on the necessity.

The invention claimed is:

1. A stripper plate mounting apparatus for mounting a stripper plate in a detachable and replaceable manner above a front end portion of a punch guide into which a punch including an edge part in its front end portion is fitted movably upward and downward, comprising:

an adaptor detachably provided to the front end portion of the punch guide, the adaptor holding the stripper plate, and a plurality of lock parts being respectively formed in a plurality of locations on the adaptor; and a plurality of lock mechanisms provided in a plurality of locations on an outer periphery of the front end portion of the punch guide so as to correspond to locations of the plurality of lock parts formed in the adaptor, respectively, wherein the lock mechanisms each comprise:

a lock piece capable of being locked to, and detached from, a corresponding one of the lock parts formed in the adaptor;

a biasing module that continuously biases the lock piece outward in a radial direction; and a lock-holding piece to lock and to hold the lock piece in an inward position when the lock piece is pressed and moved inward in the radial direction, and wherein the adaptor is fixed to the punch guide with the lock mechanisms.

2. The stripper plate mounting apparatus according to claim 1, wherein the lock-holding piece is biased towards the lock piece; and the lock-holding piece is capable of moving together with the lock piece in the radial direction due to a biasing force of the biasing module.

3. The stripper plate mounting apparatus according to claim 2, wherein an engagement concave part is formed in an opposing surface of the lock piece, the opposing surface being opposed to the lock-holding piece; and the lock-holding piece includes a convex part engageable with, or detachable from, the engagement concave part.

4. The stripper plate mounting apparatus according to claim 3, wherein when the adaptor is removed from the punch guide, the lock-holding piece protrudes more outward than the lock piece.

* * * * *